US008973653B2

(12) United States Patent
Thornburrow et al.

(10) Patent No.: US 8,973,653 B2
(45) Date of Patent: Mar. 10, 2015

(54) RUNNING TOOL

(75) Inventors: Edward T. Thornburrow, Drighlington (GB); Gavin P. Robottom, Leeds (GB)

(73) Assignee: Cameron International Corporation, Houston, TX (US)

( * ) Notice: Subject to any disclaimer, the term of this patent is extended or adjusted under 35 U.S.C. 154(b) by 356 days.

(21) Appl. No.: 13/499,354

(22) PCT Filed: Jan. 27, 2012

(86) PCT No.: PCT/US2012/022942
§ 371 (c)(1), (2), (4) Date: Mar. 30, 2012

(87) PCT Pub. No.: WO2012/103460
PCT Pub. Date: Aug. 2, 2012

(65) Prior Publication Data

US 2012/0285678 A1 Nov. 15, 2012

(30) Foreign Application Priority Data

Jan. 28, 2011 (GB) ..... 1101466.9

(51) Int. Cl.
*E21B 23/01* (2006.01)
*E21B 4/00* (2006.01)
*E21B 41/00* (2006.01)

(52) U.S. Cl.
CPC ..... *E21B 23/01* (2013.01); *E21B 4/006* (2013.01); *E21B 41/00* (2013.01)
USPC ..... 166/206; 166/381

(58) Field of Classification Search
CPC ..... E21B 23/00; E21B 23/04
USPC ..... 166/381, 382, 206, 212
See application file for complete search history.

(56) References Cited

U.S. PATENT DOCUMENTS

| | | | |
|---|---|---|---|
| 4,019,579 | A | 4/1977 | Thuse |
| 4,615,544 | A | 10/1986 | Baugh |
| 4,903,776 | A | 2/1990 | Nobileau et al. |

FOREIGN PATENT DOCUMENTS

| | | |
|---|---|---|
| GB | 1532256 | 11/1978 |
| GB | 2401129 | 11/2004 |

OTHER PUBLICATIONS

Scott, Foreign Search Report for GB1101466.9, dated Mar. 14, 2011.
International search report and written opinion for application No. PCT/US2012/022942 mailed May 11, 2012.

*Primary Examiner* — Brad Harcourt
(74) *Attorney, Agent, or Firm* — Eubanks PLLC

(57) ABSTRACT

A running tool (10) for inserting and setting an assembly into a bore in a well, the tool comprising a main body (11) having a hydraulic cylinder (12) for actuating one or more locking elements (60, 61) on the main body for, in use, reaction with the bore, an outer sleeve (40) rotatably mounted on the main body, a rotatable mandrel (13) to which, in use, torque is applied and means (42, 43, 44) for transmitting the torque from the mandrel to the outer sleeve.

13 Claims, 5 Drawing Sheets

RUNNING TOOL

TECHNICAL FIELD

This invention relates to a running tool for inserting and setting an assembly into a bore in a well. The running tool may be for inserting a seal assembly or any other such item that is set by the application of axial force (which may be produced hydraulically within the tool) and then locked into a bore of a well housing by means of rotation.

BACKGROUND

Conventionally, assemblies which need to be inserted and set into a bore in a well typically require other multiple tools which necessitate more than one trip down the well or other than one rotation step, if multiple elements in the tool must be rotated. This leads to increased complexity and increased installation time, and therefore a greater time for which the well is not operational.

In practice, as an example, a seal assembly typically needs to be locked in place by rotation of one item to around 60,000 lb feet of torque and then subsequent rotation of a second item to around 12,000 lb feet to lock the hanger and seal assembly in place. This requires two separate rotation steps, and may be done either in one or two trips. Furthermore, the high torque figure required means that conventional tools are particularly large and heavy, and cause significant safety issues in achieving such high torques in a controlled manner.

SUMMARY

Thus, the present invention aims to provide a tool which reduces the amount of torque that is necessary and which can minimise the number of rotations required to insert and set an assembly in to a bore in a well.

According to the present invention, there is provided a running tool for inserting and setting an assembly in to a bore in a well, the tool comprising:

- a main body having a hydraulic cylinder for actuating one or more locking elements on the main body for, in use, reaction with the bore;
- an outer sleeve rotationally mounted on the main body;
- a rotatable mandrel to which, in use, torque is applied; and
- means for transmitting the torque from the mandrel to the outer sleeve.

Thus, the present invention provides a hydraulic cylinder for actuating the assembly, thereby avoiding the high torque requirement for the initial locking step in the prior art. Furthermore, the present invention requires only the rotation of the outer sleeve, via rotation of the mandrel, for subsequent insertion and setting of the assembly within the bore.

The running tool may further comprise a piston arranged to cause relative movement of the piston and the hydraulic cylinder.

The hydraulic cylinder is preferably axially mounted within the main body. The mandrel is also preferably axially mounted in the main body and, when this occurs, the mandrel is preferably surrounded by the hydraulic cylinder.

The mandrel may extend through the hydraulic cylinder such that the mandrel has a driven end extending from one end of the hydraulic cylinder and a transmitting end extending from the other end of the cylinder.

The torque transmitting means may be a planetary gear system which is preferably mounted on the mandrel at the distal torque transmitting end. The planetary gear typically consists of a sun gear and a plurality of planetary gears and the sun gear is preferably mounted on the mandrel at the distal end. The planetary gears are preferably mounted between the sun gear and an inner wall of the outer sleeve of the running tool. In this way, torque is transmitted from the mandrel, via the sun gear, to the planetary gears and on to the outer sleeve. Rotation of the outer sleeve causes, in use, the assembly which is being inserted to be set in place in the bore in a well.

The locking element(s) of the running tool preferably include one or more locking dogs or split lock rings.

BRIEF DESCRIPTION OF THE DRAWINGS

One example of the present invention will now be described with reference to the accompanying drawings, in which.

DETAILED DESCRIPTION OF SPECIFIC EMBODIMENTS

Figure 1:
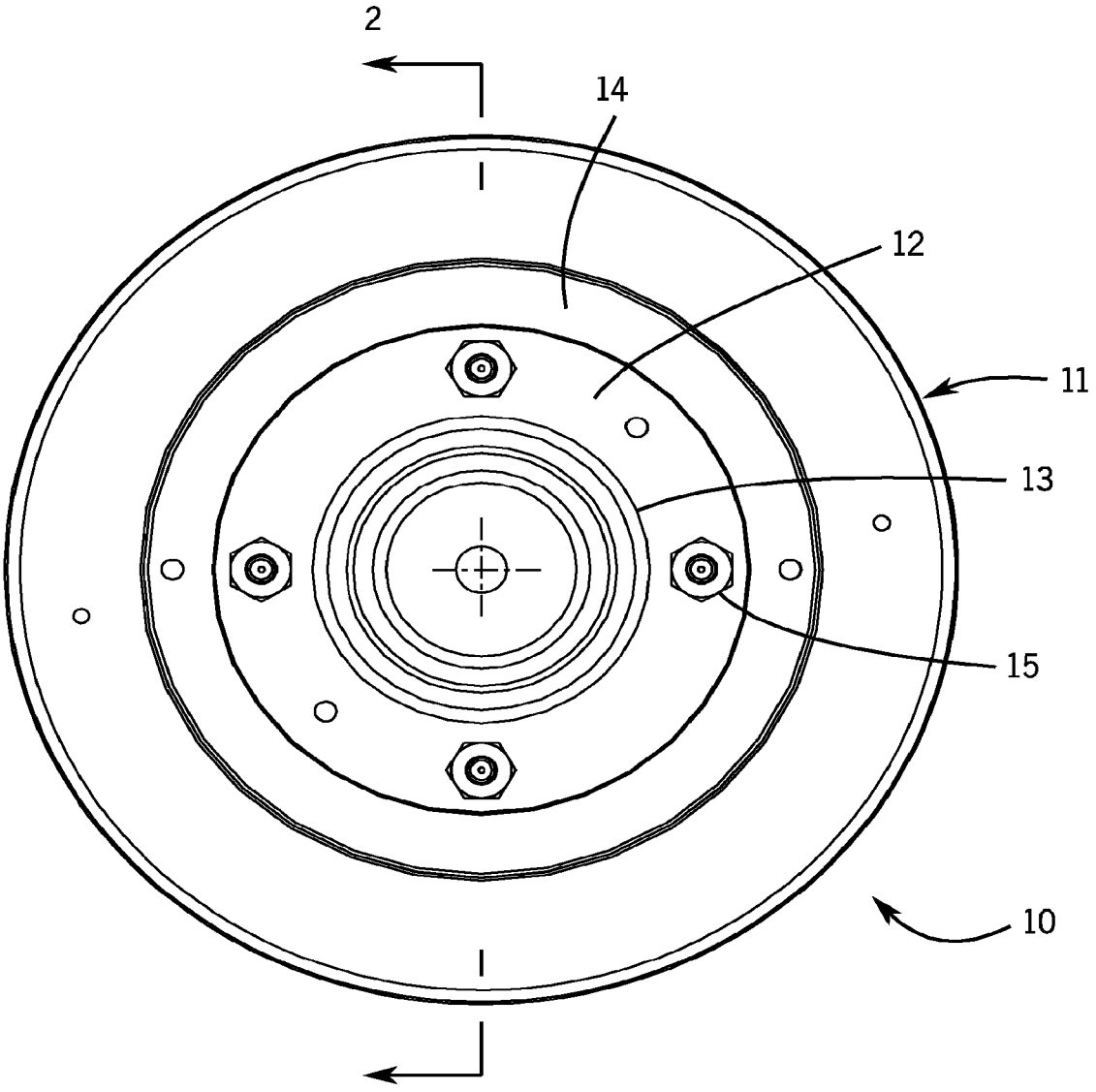
FIG. 1 shows a top end view of the present invention.
Figure 2:
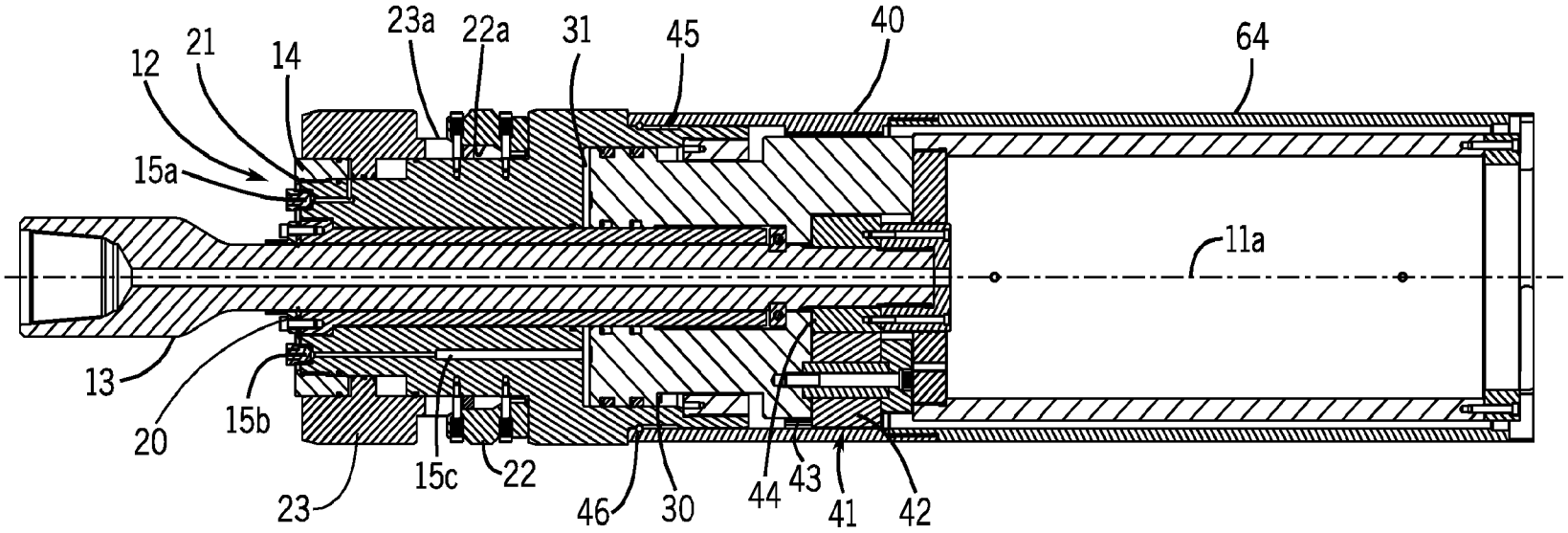
FIG. 2 shows a cross sectional view along the axis of the tool of FIG. 1.
Figure 3:
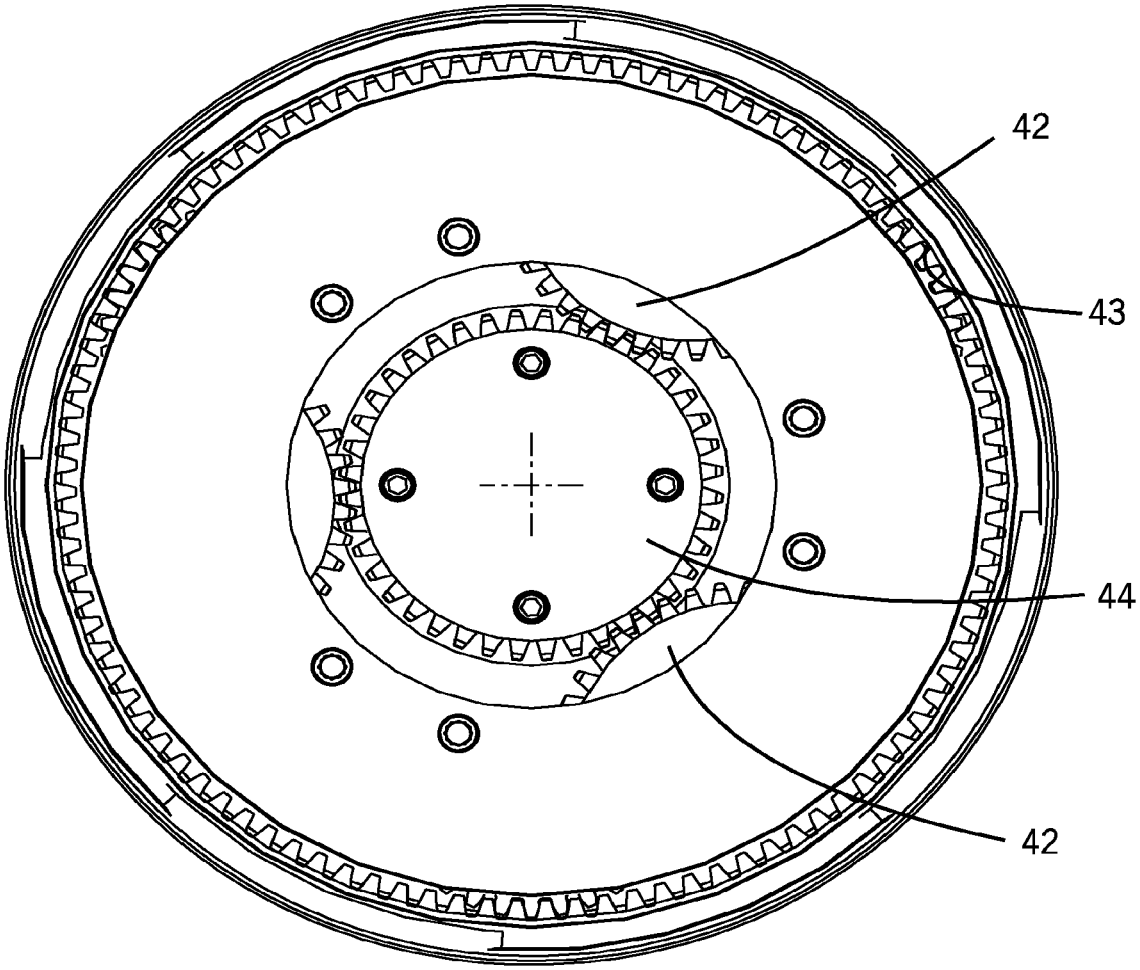
FIG. 3 shows a cross sectional view across the gears in FIG. 2.

The top end view of FIG. 1 shows a running tool 10 having a main body 11, having an axis 11*a* (FIG. 2). Coaxially mounted with the main body 11 are a hydraulic cylinder 12 and a rotatable mandrel 13. A retaining ring 14 is radially located between the hydraulic cylinder 12 and the main body 11. A plurality of plugs 15 is located in the end wall of the hydraulic cylinder. One or more of these plugs may have openings through which, in use, hydraulic fluid can be supplied and/or vented during operation.

Turning now to FIG. 2, the invention can be seen in greater detail. In particular, the hydraulic cylinder 12 is provided with an inner body 20 and an outer body 21. The inner body is located adjacent to the mandrel 13, with the outer body radially outwards of the inner body.

The tool is also provided with a split lock ring 22 which is, in use, moved out radially so as to engage with a groove 72 in a high pressure housing (or riser) 70 (sec FIG. 4) in a well. The locking ring is caused to move radially outwards by an actuation piston 23 which is retained in position by a retainer ring 14. In use, hydraulic fluid is supplied through plug 15*a* and into an annulus between a shoulder of piston 23 and an end surface of retainer ring 14. This causes the piston to move, in FIG. 2, to the right, thereby causing the stepped outer surface 23*a* of the piston 23 to engage with the corresponding inner surface 22*a* of the split lock ring. The lock ring segments are thereby caused to move radially outwards and engage with the high pressure housing in the well. In this way, the tool is locked into the housing and gives a reaction point for the hydraulic setting piston 30. To disengage the lock ring segments, the hydraulic fluid previously supplied through plug 15*a* may be vented from the annulus between the shoulder of the piston 23 and the end surface of the retainer ring 14, and hydraulic fluid may be supplied from another plug to the annulus between the opposite side of the shoulder of the piston 23 and the outer body 21. This causes the piston to move, in FIG. 2, to the left, allowing springs of the cap screws that retain the lock ring segments on the outer body 21 to move the lock ring segments radially inwards (e.g., to disengage groove 72).

Figure 5:
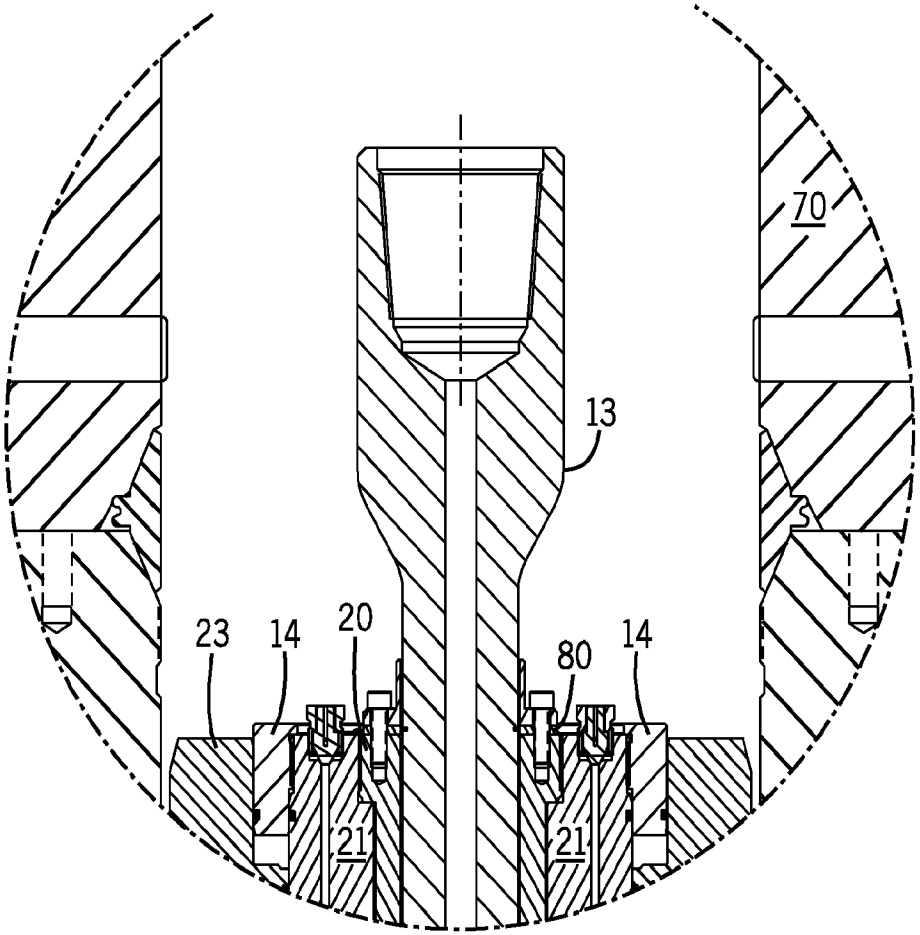
FIG. 5 shows the provision of a shear ring on the tool of FIG. 2.

The mandrel 13 is typically retained to the hydraulic cylinder 12 by means of a shear ring 80, shown in FIG. 5. The shear ring ensures that the assembly doesn't expand prematurely, and that the split lock ring 22 will be level with the grooves in the housing 70 when the assembly lands out.

A further piston 30, this time typically for setting the seal, is located around the distal end of the inner part of the hydraulic cylinder and, together with the inner and outer cylinder bodies defines an annular chamber 31. This chamber is supplied with hydraulic fluid via plug 15*b* and along pathway 15*c* through the outer body of the cylinder. In use, supply of hydraulic fluid through plug 15*b* causes the chamber 31 to expand causing relative movement of the piston 30 and the hydraulic cylinder.

In particular, in use, hydraulic fluid is supplied to plug 15*b* only once the split lock ring 22 has been expanded radially. Thus, the piston 30 is forced, in FIG. 2, to the right and the hydraulic cylinder 12 is caused to move, in FIG. 2, to the left. In practice, this means that the locking elements of the split lock ring 22 are forced upwards in the well (e.g. upwards in FIG. 4) to such a force that the shear ring shears and the locking elements are forced against an upper shoulder 71 of a groove 72 in the high pressure housing 70. The piston 30 is then able to move, in the well, in a downward direction thereby energising the seals in the casing hanger packoff assembly (see FIG. 4).

The tool has an outer sleeve 40 which is rotatable relative to the piston 30 and the hydraulic cylinder 12. Such rotation is achieved by the use of a planetary gear system 41 which includes a plurality of planetary gears 42 which are in driving engagement with an internal gear 43 in the outer sleeve 40. The planetary gear or gears 42 engage with a sun gear 44 which is mounted around the distal end of the mandrel 13. Thus, rotation of the mandrel 13 as it passes through the hydraulic cylinder causes the sun gear 44 to be rotated. Such rotation is passed on to the planetary gears and subsequently on to the outer sleeve 40.

Thus, in use, whilst holding the seal setting pressure through plug 15*b*, the mandrel 13 is rotated to rotate the sun gear 44, thereby rotating the, typically, three planetary gears 42 which in turn rotate the outer sleeve 40. In use, the outer sleeve assembly moves down in the well (to the right in FIG. 2) and means that the outer sleeve 40 can travel axially independently of the rest of the tool. An extended groove 45, in this example located in the outer hydraulic cylinder housing, but it could be located in the inner wall 43 of the outer sleeve 40, co-operates with ball bearings 46 to assist in the independent movement of the outer sleeve 40 with respect to the rest of the tool.

The movement of the outer sleeve downwards in the well causes an energising ring on the casing hanger packoff assembly to be rotated, thereby expanding a lock ring. The casing hanger packoff lock ring then engages in a groove in the high pressure housing. Continued rotation of the outer sleeve and thus the energising ring in the packoff causes locking pins to be sheared, thereby allowing a further ring in the packoff to be rotated to lock the packoff and hanger in place.

Figure 4:
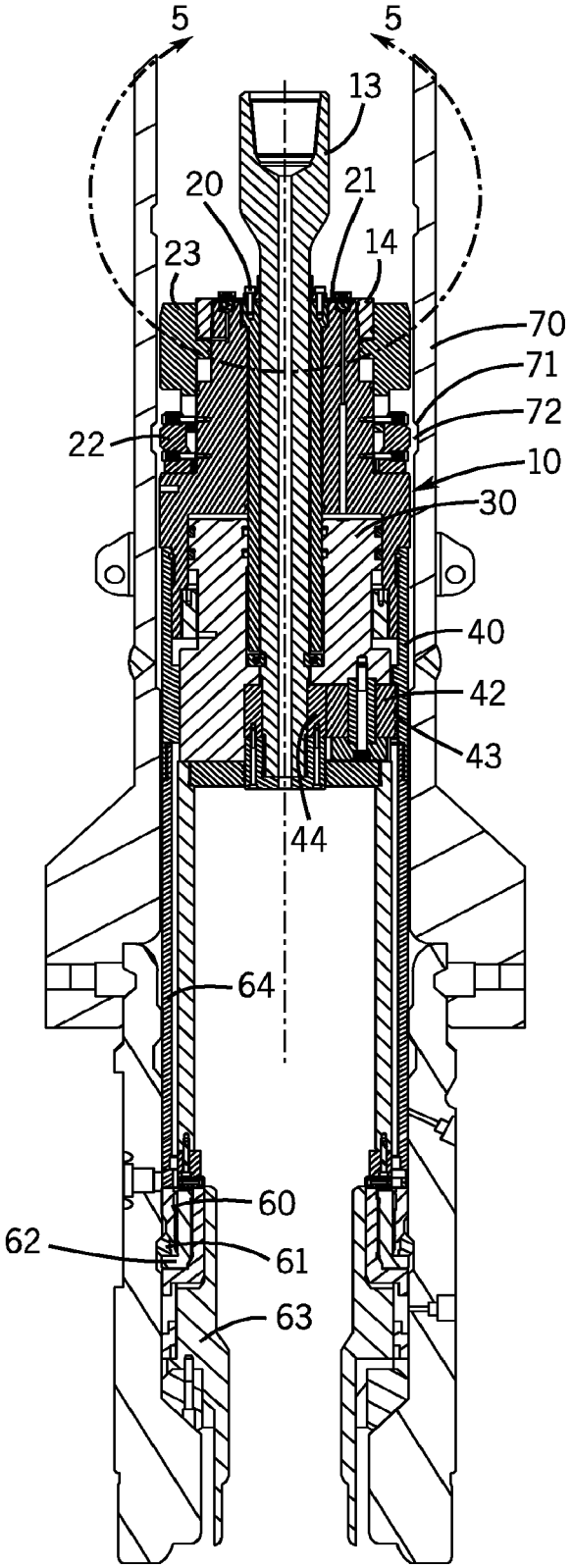
FIG. 4 shows a running tool seal assembly and hanger.

This is shown in reference to FIG. 4 which shows the energising ring 60, the casing hanger lock ring 61 in the casing hanger packoff 62. It also illustrates the casing hanger 63 which is being inserted and the connection of the running tool 10 and, in particular, the outer sleeve 40 to the energising ring 60 by virtue of an extension 64 of the outer sleeve.

The invention claimed is:

1. A running tool for inserting and setting an assembly into a bore in a well, the tool comprising:

a main body having a hydraulic cylinder and a piston for actuating one or more locking elements on the main body for, in use, reaction with the bore;

an outer sleeve rotatably mounted on the main body;

a rotatable mandrel to which, in use, torque is applied, wherein the rotatable mandrel is configured to be operated independently of the piston; and means for transmitting the torque from the mandrel to the outer sleeve.

2. A running tool according to claim 1, further comprising an additional piston arranged to cause relative movement of the additional piston and the hydraulic cylinder.

3. A running tool according to claim 2, wherein the running tool is configured to enable relative movement of the additional piston and the hydraulic cylinder to cause relative movement of the mandrel with respect to the hydraulic cylinder.

4. A running tool according to claim 1, wherein the hydraulic cylinder and the mandrel are axially mounted within the main body.

5. A running tool according to claim 1, wherein the mandrel extends through the hydraulic cylinder.

6. A running tool according to claim 5, wherein the mandrel has a driven end and a distal end, the distal end extending outside the hydraulic cylinder.

7. A running tool according to claim 6, wherein the driven end of the mandrel extends outwardly from one end of the hydraulic cylinder and the distal end of the mandrel extends outwardly from an opposite end of the hydraulic cylinder.

8. A running tool according to claim 1, wherein the torque transmitting means is a planetary gear system.

9. A running tool according to claim 8, wherein a sun gear is mounted on the mandrel.

10. A running tool according to claim 9, wherein one or more planetary gears are mounted between the sun gear and an inner wall of the outer sleeve, such that torque is transmitted from the mandrel, via the sun gear to the one or more planetary gears and on to the outer sleeve.

11. A running tool according to claim 1, wherein the locking elements include one or more dogs or split lock rings.

12. A running tool according to claim 1, comprising a shear ring for retaining the mandrel to the hydraulic cylinder.

13. A running tool for inserting and setting an assembly into a bore in a well, the tool comprising:

a main body having a hydraulic cylinder for actuating one or more locking elements on the main body for, in use, reaction with the bore;

an outer sleeve rotatably mounted on the main body;

a rotatable mandrel to which, in use, torque is applied; and means for transmitting the torque from the mandrel to the outer sleeve, wherein the torque transmitting means is on the opposite side of the locking elements to a driven end of the mandrel.

* * * * *